United States Patent [19]

Takada

[11] Patent Number: 4,766,936

[45] Date of Patent: Aug. 30, 1988

[54] CARD SWITCHING APPARATUS FOR DOBBY

[75] Inventor: Hiroshi Takada, Kyoto, Japan

[73] Assignee: Murata Kikai Kabushiki Kaisha, Kyoto, Japan

[21] Appl. No.: 816,742

[22] Filed: Jan. 6, 1986

[30] Foreign Application Priority Data

Jan. 17, 1985 [JP] Japan ..... 60-7006

[51] Int. Cl.[4] ..... D03D 51/00

[52] U.S. Cl. ..... 139/324; 139/68; 139/329

[58] Field of Search ..... 139/329, 324, 1 E, 68, 139/325, 70, 71, 72

[56] References Cited

U.S. PATENT DOCUMENTS

| | | | |
|---|---|---|---|
| 193,874 | 8/1877 | Jennings | 139/329 |
| 3,891,010 | 6/1975 | Lyman, Jr. et al. | 139/1 E |
| 4,250,930 | 2/1981 | Palau et al. | 139/329 |
| 4,351,368 | 9/1982 | Palau | 139/329 |
| 4,448,220 | 5/1984 | Zwiener et al. | 139/1 E |
| 4,570,681 | 2/1986 | Wada | 139/1 E |

FOREIGN PATENT DOCUMENTS

| | | | |
|---|---|---|---|
| 3044210 | 6/1982 | Fed. Rep. of Germany | 139/329 |

*Primary Examiner*—Harvey C. Hornsby
*Assistant Examiner*—Joseph S. Machuga
*Attorney, Agent, or Firm*—Spensley, Horn, Jubas & Lubitz

[57] ABSTRACT

A card switching apparatus for a dobby comprises a bracket mounted for rocking motion around a shaft, a cylinder supported on said bracket and having a rotary shaft, a gear securely mounted on said rotary shaft of said cylinder, an input power shaft, another gear securely mounted on said input power shaft, and an idle gear interposed between the two gears, and that said idle gear has a rotary shaft which is supported for movement along a particular locus and which is moved in response to a rotational angle of a motor shaft.

3 Claims, 6 Drawing Sheets

CARD SWITCHING APPARATUS FOR DOBBY

FIELD OF THE INVENTION AND RELATED ART STATEMENT

This invention relates to a card switching apparatus for a dobby.

In a loom which includes a dobby machine therein, a weft yarn led into a shed of warp yarns becomes sometimes broken by some causes. In such a case, in order to prevent destruction of a texture, operation of the loom is stopped first, and a card reading position of the dobby upon such breakage of the weft yarn is restored whereafter a broken piece of the weft yarn is removed. In such restoring operation, at first either a pattern card or a cylinder on which pegs are implanted for instruction of a texture is moved by one pick to a reverse rotation position, and then the loom is moved stepwise in the reverse direction to return to the shedding condition at the time when the weft yarn was broken. In this condition, the broken piece of the weft yarn which remains in the shed of the warp yarns is removed, and then only the card or the peg cylinder is returned to a forward rotation position to re-start the ordinary weaving operation of the loom.

Meanwhile, in such a loom as described above, a plurality of heald frames are positioned to a same level, and a so-called levelling operation such as threading of weft yarns or adjustment of the shedding amount is carried out. In such a case, the peg cylinder or a card cylinder may in some cases be mounted for movement such that the card or the peg cylinder can move to a spaced position in which all of reading levers adapted to be displaced in response to presence or absence of pegs are clear of the pegs.

In such a reversing or levelling operation as described above, to reverse the card or the peg cylinder or to move the same to its levelling position, conventionally a gear of a drive system for the peg cylinder is rotated or displaced by means of a manually operable lever.

When an operator operates such an elongated manually operable lever as described above, a strong force is required. Besides, in order to keep the lever to the reverse rotation position or to the levelling position after the lever has been moved thereto, a stopping member which has, for example, three recessed grooves formed therein is required, and when the lever is changed over from a normal position to the reverse rotation position or to the levelling position, an excessive load may be applied due to movement of the lever from within one into another engaging or stopping recessed groove, which may make the lever itself loose or which may cause an excessive load to be applied to a gear shaft connected to the lever, resulting in damage to a tooth face of the gear. Or in some cases, when the lever is shifted back to the levelling position to the forward rotation position, teeth of gears may interfere with each other, resulting in failure in meshing engagement of the gears.

In addition, also upon reverse rotation of the cylinder, the rotary shaft of the peg cylinder may sometimes be displaced to reduce the degree of meshing engagement of hooks upon reversing operation of the loom, which will cause a trouble that the meshing engagement of the hooks becomes insufficient or the hooks are disengaged from each other.

OBJECT AND SUMMARY OF THE INVENTION

It is an object of the present invention to propose an apparatus for a dobby in which upon reversing operation when a weft yarn has been broken or upon levelling operation, desired operation can be attained simply in response to depression of a button switch.

According to the present invention, a card switching apparatus for a dobby comprises a bracket mounted for rocking motion around a shaft, a cylinder supported on the bracket and having a rotary shaft, a gear securely mounted on the rotary shaft of the cylinder, an input power shaft, another gear securely mounted on the input power shaft, and an idle gear interposed between the two gears, the idle gear having a rotary shaft which is supported for movement along a cam slot of a specific geometry, the movement of the idle gear being associated with an eccentric crank lever which is connected to be driven by a motor.

According to the present invention, by differentiating the rotational angle of a motor shaft, the amount of displacement of the eccentric crank lever is differentiated so that the rotary shaft of the idle gear connected to the crank lever is moved either to the reverse rotation position or to the levelling position along the cam slot. Accordingly, either the gear of the card cylinder is rotated reversely or a rocking bracket is rocked in response to the amount of displacement of the card cylinder.

DETAILED DESCRIPTION OF PREFERRED EMBODIMENTS

Now, an embodiment of the present invention will be described with reference to the drawings.

Figure 3:
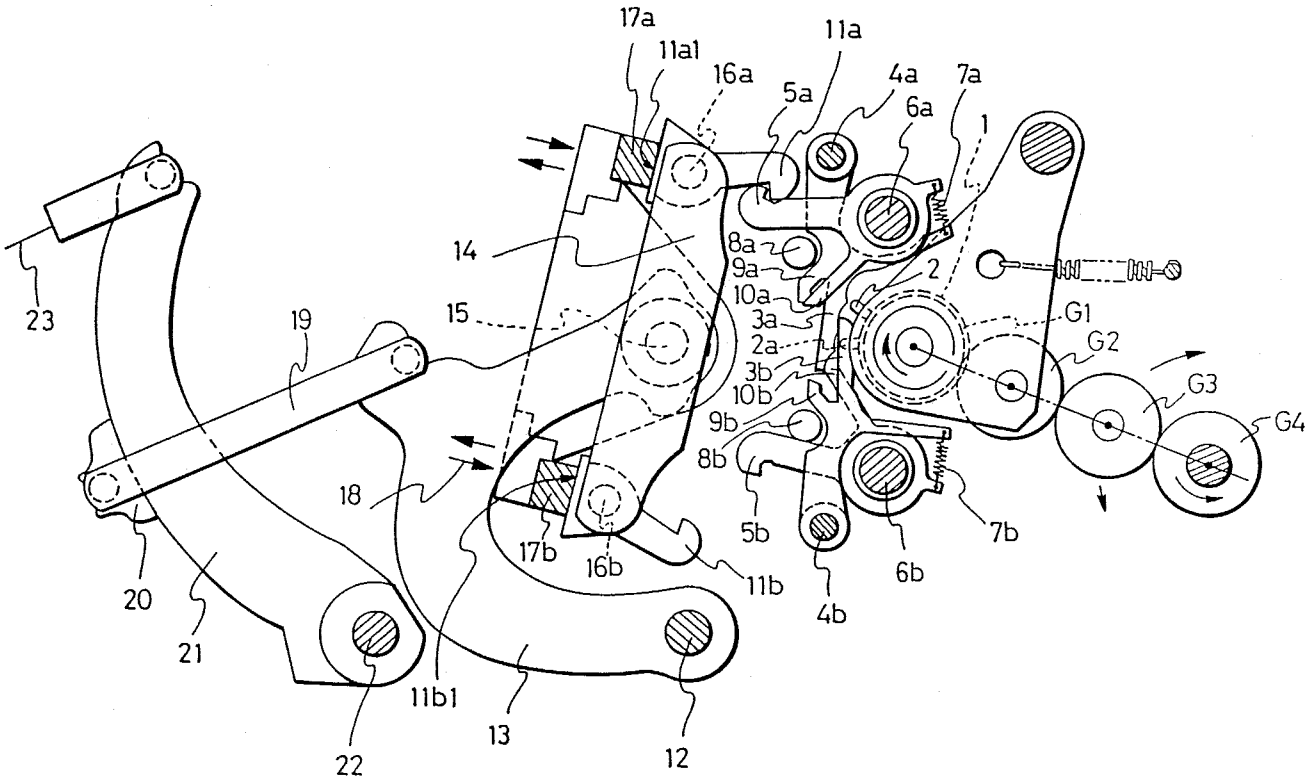
FIG. 3 is a front elevational view illustrating general construction of a dobby to which the present invention is applied.

A general construction of a dobby to which an apparatus of the present invention is applied is shown in FIG. 3.

A pair of reading levers 3*a* and 3*b* are supported on fixed shafts 4*a* and 4*b*, respectively, for pivotal motion between two positions in response to presence and absence of pegs 2 on a cylinder 1. A pair of engaging hooks 5*a* and 5*b* are supported on different fixed shafts 6a and 6b for pivotal motion in response to displacement of the reading levers 3a and 3b, respectively.

A tension spring 72 extends between the reading lever 3a and the engaging hook 5a so as to allow substantially integral motion of the reading lever 3a and the engaging hook 5a except that, upon engagement with a movable hook as described hereinafter, only the engaging hook 5a makes relative motion to the reading lever 3a against the urging of the spring 7a. Another tension spring 7b similarly extends between the other reading lever 3b and the associated engaging hook 5b. A pair of positioning stoppers 8a and 8b for positioning the engaging hooks 5a and 5b to respective disengaging positions, respectively, are secured to a frame.

The spring 7a acts in a direction to urge a slider 9a integrally formed on the reading lever 3a into engagement with an arm 10a integrally formed on the engaging hook 5a and to urge the reading lever 3a and the engaging hook 5a in a counterclockwise direction around the shafts 4a and 6a, respectively, thereby to engage the reading lever 3a with a peg 2 on the cylinder 1. The other slider 9b and the arm 10b have a similar relationship and are urged in this instance in a clockwise direction around the shafts 4b and 6b, respectively, by the spring 7b, In FIG. 3, by a peg 2a on the cylinder 1, the reading lever 3a corresponding to the peg 2 is pivoted around the shaft 4a to a position in which the integrally pivoting engaging hook 5a is engaged with a movable hook 11a.

Meanwhile, a balk lever 13 is supported on a different fixed shaft 12, and a balk 14 is supported at a mid portion thereof for pivotal motion at an end portion of the balk lever 13 by means of a shaft 15 such that it can rotate around the shaft 15. A pair of movable hooks 11a and 11b are supported at opposite ends of the balk 14 for pivotal motion to selectively engage with and disengage from the engaging hooks 5a and 5b, respectively.

Accordingly, the movable hooks 11a and 11b are alternately pushed at rear end faces 11a and 11b thereof by a pair of pushing bars 17a and 17b, respectively, which are alternately reciprocated in response to the loom, so that the movable hooks 11a and 11b are engaged with the engaging hooks 5a and 5b positioned in prior at the respective engaging positions to pivot the balk lever 13 by a predetermined fixed angle in the clockwise direction around the fixed shaft 12. For example, if the lower pushing bar 17b pushes the rear end face 11b of the movable hook 11b in a direction of an arrow mark 18 from a position of FIG. 3 in which the upper movable hook 11a is in engagement with the associated engaging hook 5a, the balk 14 is forced to pivot in the counterclockwise direction around the shaft 16a for the upper movable hook 11b since the top end of the balk 14 is held from movement by the engaging hook 5a. As a result, the balk lever 13 on which the balk 14 is supported for pivotal motion is pivoted by the predetermined fixed angle in the clockwise direction around the fixed shaft 12.

As a result, a jack lever 21 which is connected to the balk lever 13 by way of a connecting rod 19 and an adjuster 20 is pivoted in the clockwise direction around a fixed shaft 22 to pull a wire cable 23 connected thereto to move up or down a heald frame of the loom not shown which is suspended from the wire cable 23. After then, the jack lever 21 is pivoted in the counterclockwise direction from the formerly pivoted position thereof by a restoring spring for the heald frame to move down or up the heald frame thereby to control shedding movement of the warp yarns. This proves that the machine is a so-called negative dobby.

Now, description will be given of a reading device for controlling engaging and disengaging positions of the engaging hooks 5a and 5b, a reversing operation of the above described loom, and a card switching apparatus for levelling operation with reference to FIGS. 1 to 4.

Figure 1:
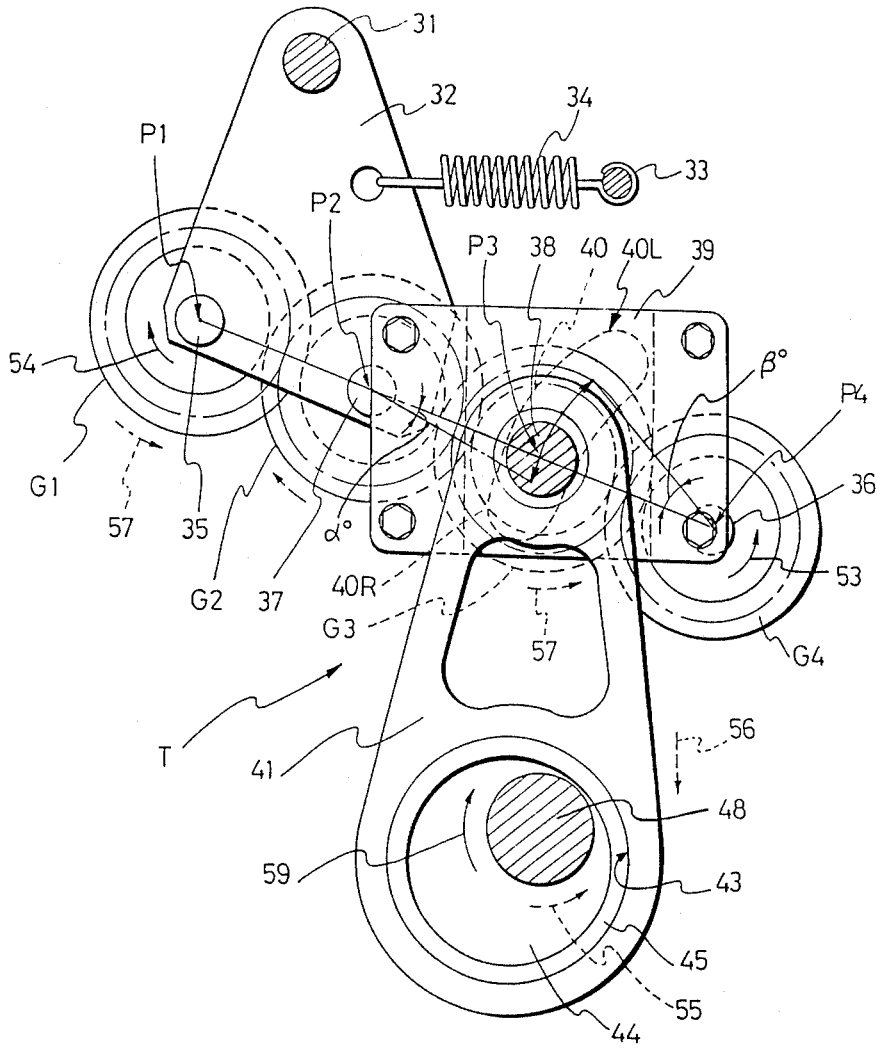
FIG. 1 is a front elevational view of part of an apparatus according to one embodiment of the present invention.
Figure 2:
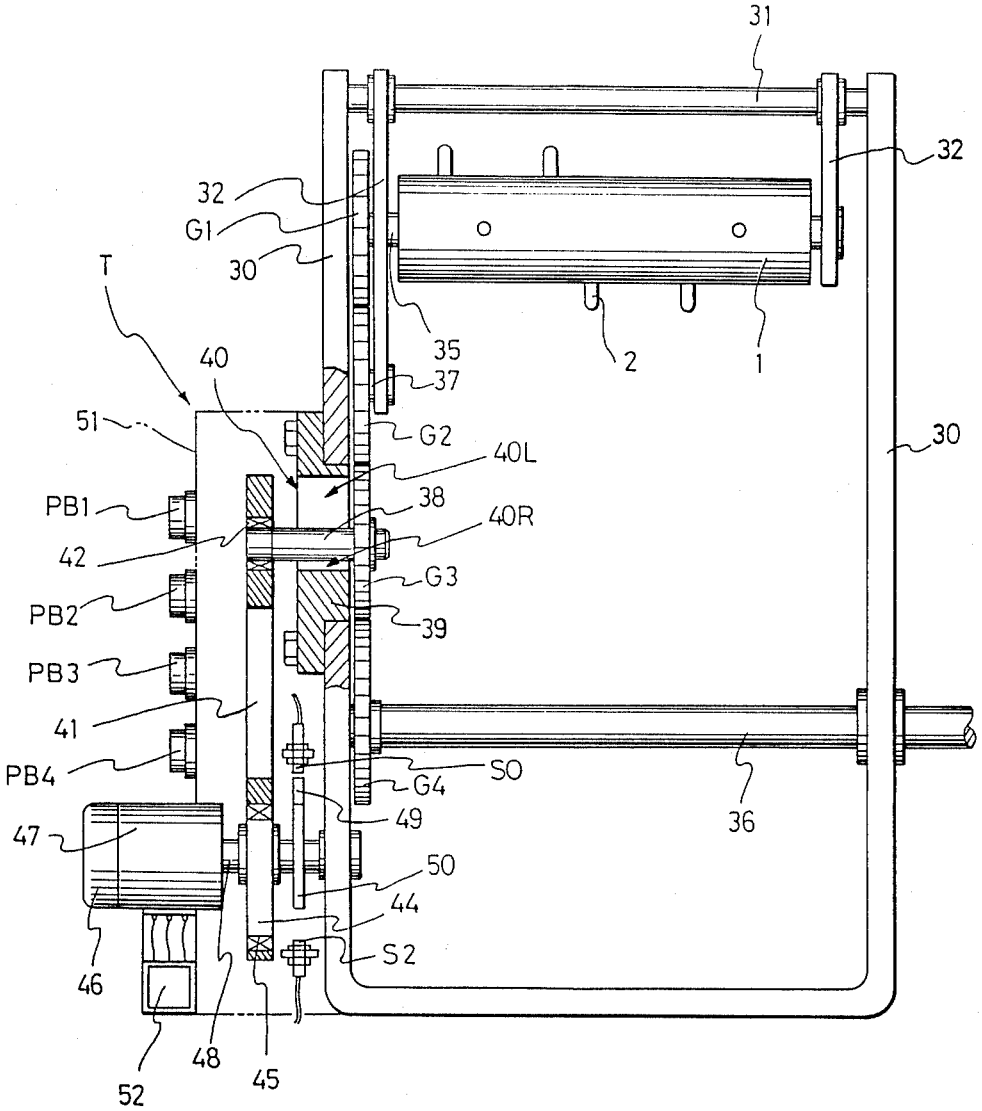
FIG. 2 is a side elevational view, partly in section, illustrating a train of gears G1 to G4 of FIG. 1 developed in a vertical direction.

Referring first to FIGS. 1 and 2, the cylinder 1 around which a card having pegs implanted thereon is wound is supported for rotation on a pair of movable brackets 32 which are mounted for pivotal motion around a shaft 31 secured to a frame 30. The brackets 32 are urged in the counterclockwise direction around the shaft 31 by a spring 34 extending between one of the brackets 32 and a fixed pin 33. A gear G1 is securely mounted at an end of a shaft 35 of the cylinder 1 and is connected via intermediate idle gears G2 and G3 to a drive gear G4 secured to an input power shaft which is driven in response to the loom so that rotation of the input power shaft 36 may be transmitted to intermittently rotate the cylinder 1 in response to the motion of the loom.

The intermediate idle gear G2 is supported on a shaft 37 on the one bracket 32 by way of a bearing and is in meshed engagement with the gear G1 on the shaft 35 of the cylinder 1. The gears G1 and G2 move in integral relationship when the brackets 32 are pivoted. The other idle gear G3 is mounted for rotation by way of a bearing on an intermediate shaft 38 which is displaced by means of an eccentric crank lever which will be hereinafter described.

During normal operation, the centers of rotation, that is, the axes P1 to P4 of the gears G1, G2, G3 and G4 are positioned on a straightline as seen in FIG. 1.

The shaft 38 on which the idle gear G3 is supported extends through a cam slot 40 of a specific geometry formed in a cam plate 39 which is secured to an extends through the frame 30. The shaft 38 has an end connected to and supported on a crank lever 41 by way of a bearing 42. The crank lever 41 has a round hole 43 formed at the other end thereof. An eccentric disk 44 is fitted in the round hole 43 of the crank lever 41 and is secured to a shaft 48 of a motor 47 with a brake 46.

Accordingly, the crank lever 41 is displaced in a substantially vertical direction to move the shaft 38 along the cam slot 40 in response to a rotational angle of the motor shaft 48.

The cam slot 40 consists of a levelling cam slot 40L formed to extend from a position corresponding to the forward rotation position of the shaft 38 for normal operation to an arc centering around the axis P4 of the gear G4, and another reverse rotating cam slot 40R formed contiguously to the levelling cam slot 40L and extending from the aforementioned position to another arc centering around the axis P2 of the gear G2. While the cam slots 40R and 40L are shown to extend in opposite directions from the forward rotation position P3 of the shaft 38, they can otherwise be formed to extend in a same direction. In particular, a levelling cam slot may be formed in contiguous relationship to the reverse rotating cam slot 40R as of FIG. 1 while the shaft 38 in its forward rotation position is positioned at an end of the integral cam slot.

Figure 4:
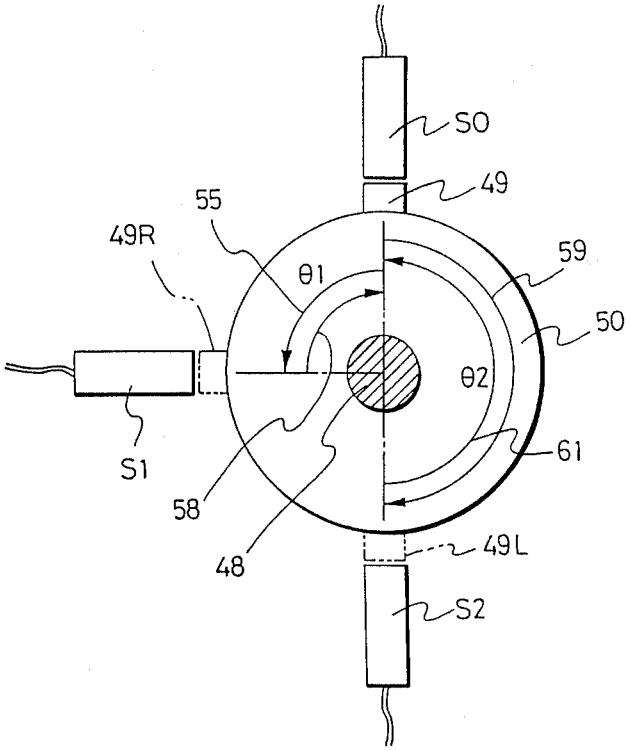
FIG. 4 is a front elevational view illustrating an arrangement of sensors for controlling a rotational angle of a motor shaft.

Further, a rotary plate 50 having a dog 49 for detecting a rotational angle of the shaft 48 of the motor 47 is secured to the motor shaft 48, as seen in FIGS. 2 and 4. Contactless sensors S0, S1 and S2 for detecting the dog 49 are located at respective positions as shown in FIG. 4. In particular, the sensor S0 is provided for detecting the forward rotation position of the idle gear G3, and during normal operation, the dog 49 is positioned adjacent the sensor S0. The sensor S1 is located at a position displaced by an angle θ1 from the sensor S0 and is provided for detecting the reverse rotation position of the idle gear G3. The sensor S2 is located at a position displaced by an angle θ2 in the opposite direction from the sensor S0 and is provided for detecting the levelling position of the idle gear G3.

It is to be noted that while button switches PB1 to PB4 for activating the motor 47 for the reverse rotating and levelling operations are shown as mounted on a front face of a cover 51 which covers a card switching apparatus T, the switches PB1 to PB4 may otherwise be located at any position suitable for operation by an operator, for example, at a position adjacent a stepping switch of the loom. An electric circuit 52 for controlling energization of the motor 47 in response to a signal from any of the switches is provided between the switches and the motor 47.

Operation of the card switching apparatus T having such a construction as described above will now be described.

Referring to FIG. 1, during normal operation, the shaft 38 of the idle gear G3 is at a position as shown in a solid line while the centers of the gears G1 to G4 are positioned on a straight line, and thus the reading levers 3*a* and 3*b* as shown in FIG. 3 are controlled to be positioned in response to presence or absence of a peg on the cylinder 1 to effect a shedding operation. It is to be noted that the input power shaft 36 is then rotating in a direction of an arrow mark 53 and hence the gear G1 of the cylinder 1 is rotating in a direction of another arrow mark 54.

Figures 5, 6, 7:
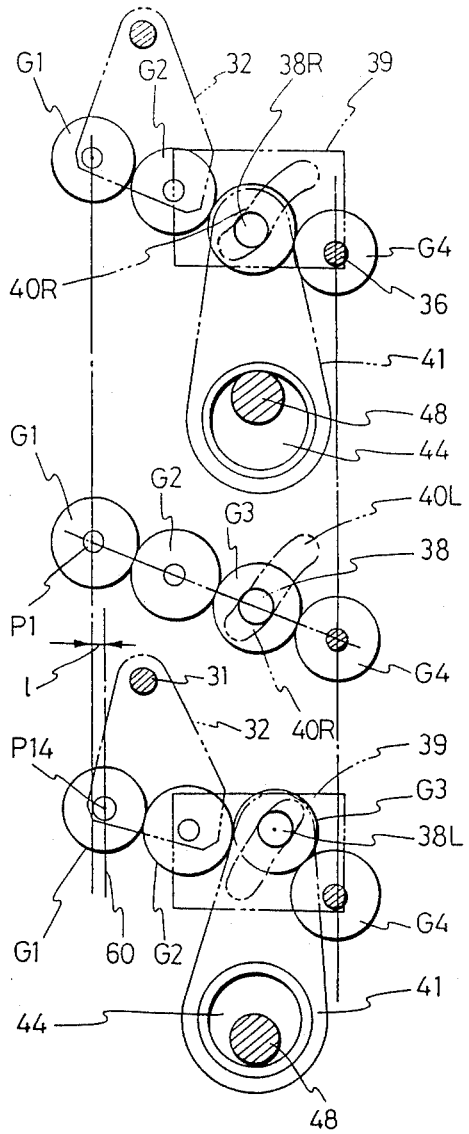
FIG. 5 is a front elevational view illustrating relative positions of the train of gears Gl to G4 in the forward rotation position.
FIG. 6 is a front elevational view illustrating relative positions of the train of gears G1 to G4 upon reverse rotating operation.
FIG. 7 is a front elevational view illustrating relative positions of the train of gears G1 to G4 upon levelling operation.

The reverse rotating operation upon breakage of a weft yarn will proceed as follows. If a weft yarn is broken and the loom and the dobby are stopped, another weft yarn which has been driven in subsequently to the broken weft yarn is first removed, and then the button switch PB1 is depressed. In response to switching on of the switch PB1, the motor 47 initiates its rotation in a direction of an arrow mark 55 in FIG. 4. Then, the motor 47 stops at a position in which the sensor S1 detects the dog 49, that is, at a position after rotation of the shaft 48 thereof by an angle θ1. Accordingly, referring to FIG. 1, by the rotation of the motor shaft 48 by the angle θ1 in the direction of the arrow mark 55, the crank lever 41 is lowered a little distance to a position as shown in FIG. 6. In the meantime, the shaft 38 of the idle gear connected to the crank lever 41 is moved from the forward rotation position (38) as seen in FIG. 5 to the reverse rotation position (38R) as seen in FIG. 6 along the cam slot 40R. In this instance, the cam slot 40R is located at the arc centering around the axis P2 of the gear G2, and accordingly only the gear G1 is rotated reversely by one pick while the axis P2 of the gear G2 remains at its former position and the gear G1 on the bracket 32 on which the gear G2 is located also remains at its former position. In other words, the input power shaft 36 is constructed such that when it is in its stopped condition, it assumes a locked condition, that is, for example, as there is an input from the loom, power is transmitted by a combination of a worm and a worm wheel. Accordingly, as the gear G3 which is meshed with the gear G4 in its locked condition is shifted to the reverse rotation position, the gears G3 and G1 will rotate in the counterclockwise direction as in FIG. 1, and hence the card on the cylinder will come to a position reversely moved by one pick. It is to be noted that the amount of movement of the axis P3 of the idle gear G3 is determined to be a value suitable for causing a rotational angle of the card by one pick, and the length of the cam slot 40R and the location of the sensor S1 which determines the rotational angle of the motor are decided accordingly.

Thus, in a condition of the reverse rotation position (FIG. 6), if a reverse rotation stepping switch of the loom is depressed, a shedding operation is carried out, and thus the shedding condition when the broken weft yarn was driven in is restored. Accordingly, the broken weft yarn can be removed by a simple operation.

After completion of removal of the weft yarn, the operator will depress the button switch PB2 for the forward rotation of the cylinder as shown in FIG. 2 to rotate the motor 47 forwardly. Then, as the dog 49R in a two dots and dash line position in FIG. 4 comes to a full line position by rotation of the rotary plate 50 by an angle θ1 in a direction of an arrow mark 58, the sensor S0 detects the dog 49 so that the rotation of the motor is stopped. As a result, the crank lever 41 which is in its displaced position as described above is also restored to its original position as shown in FIG. 1 while the shaft 38 of the idle gear G3 is also returned to its normal operation position. After then, an operation re-starting switch of the loom is turned on to re-start operation of the system beginning with an operation to drive a weft yarn into a shed in the broken condition. Accordingly, a continuous pattern and texture can be woven.

It is to be noted that while rotation of the motor is initiated by turning on of the button switch PB2 for returning the cylinder from the reverse rotation position to the forward rotation position, such modification is also possible that the switch PB2 is interlocked with a switch for a fan of the loom so that rotation of the cylinder to the forward rotation position and re-starting of operation of the loom are carried out only by depression of the button switch PB2.

Further, it is also possible to interlock the reverse rotation button switch PB1 with the reverse rotation stepping switch of the loom. In this case, after depression of the switch PB1, the reverse rotation stepping switch may be turned on by way of a predetermined time delay circuit. Or otherwise, a turning-on signal of the sensor S1 may be used for a signal for stopping the motor 47 and also for starting of the reverse rotation stepping operation.

Now, the levelling operation will be described. For levelling, the button switch PB3 of FIG. 2 is depressed to cause the motor shaft 48 to be rotated by an angle θ2 in a direction of an arrow mark 59 in FIG. 4. The motor is stopped when the dog 49 comes to a position adjacent the sensor S2. In this instance, the eccentric disk 44 secured to the motor shaft 48 is rotated in the direction of the arrow mark 59 of FIG. 1 so that the crank lever 41 is moved substantially upwardly while the shaft 38 of the idle gear G3 is moved along the cam slot 40L until a condition as shown in FIG. 7 is reached.

In particular, by displacement of the idle gear G3, the gear G2 on the spring urged bracket 32 follows the idle gear G3 so that the bracket 32 is pivoted by a predetermined angle in the counterclockwise direction around the shaft 31. As a result, the axis P14 of the cylinder gear is displaced to a position on a line 60 in which position it is spaced by a distance l from the axis P1 of the cylinder gear at the forward rotation position of FIG. 5 and pegs on the cylinder are thus all clear of the reading levers. In this condition, if the loom is moved stepwise by one pick, all of the movable hooks of FIG. 3 come to a position spaced from the engaging hooks so that all of the heald frames assume a predetermined fixed vertical position.

In this condition, after operations such as a warp yarn threading operation and an operation for adjusting the shedding amount have been completed, an operator will turn on the restoring button switch PB4 of FIG. 2 to rotate the motor shaft 48. Thus, when the motor shaft 48 is rotated by the angle $\theta 2$ in a direction of an arrow mark 61 of FIG. 4, the sensor S0 detects the dog to stop the motor. After then the shaft 38 of the idle gear G3 is returned again to the forward rotation position 38 by the crank lever 41 of FIG. 1 and is hereafter held thereto by the brake of the motor. Subsequently, the switch for starting operation of the loom will be turned on to start normal weaving operation of the loom. Also in this case, such a modification is possible that the levelling restoring button switch PB4 is associated with the switch for starting operation of the loom to obtain a loom operation starting instruction signal from a signal representing detection of the dog by the sensor S0.

Figure 8:
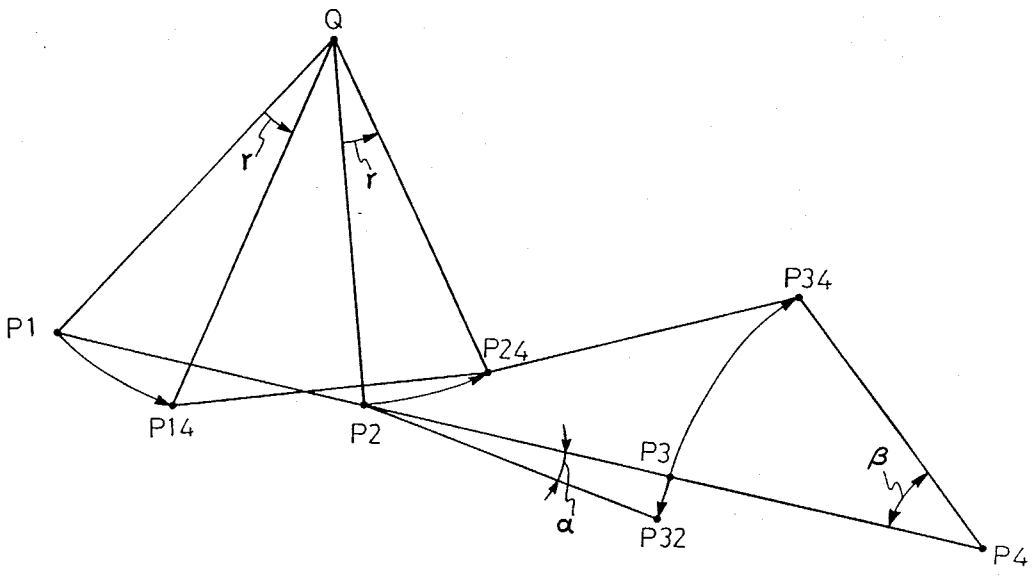
FIG. 8 is a diagrammatic representation illustrating loci of movement of the axes P1 to P4 in FIGS. 5 to 7.

Loci of movement of the gear axes upon such reversing operation and levelling operation as described above are illustrated in FIG. 8. When the axis P3 of the gear G3 is positioned at the forward rotation position, all the axes P1, P2, P3 and P4 are positioned on a straight line. Upon reversing operation, when the gear axis P3 is moved by an angle $\alpha$ around the axis P2 to a position indicated by P32, the axis P2 does not move since the distance between the axes P2 and P3 is the same as the distance between the axes P2 and P32 while the axis P1 remains at the former position. As a result, the cylinder on the axis P1 and the pegs on the cylinder take similar positions relative to the reading levers as those during normal operation.

Meanwhile, upon levelling operation, the gear axis P3 moves along a circular locus around the axis P4 of the input power shaft and by an angle $\beta$ to a position P34. As a result, the axis P2 on the spring urged movable bracket is moved by an angle $\gamma$ around a fulcrum Q of the bracket 32 and to a position P24 while the axis P1 on the same bracket is moved similarly to a position P14. It is to be noted that the distance between the axes P24 and P34 is the same as that between the axes P2 and P3 and the distance between P14 and P24 is naturally the same as that between the axies P1 and P2.

It is to be noted that the angle $\beta$ of the circular movement of the axis P3 upon levelling need not be set to a precise value and is sufficient only if pegs on the cylinder are spaced from the reading levers, and hence while the minimum value of the angle $\beta$ is specified, the maximum value need not be specified and may be set to a suitable value from a point of view of mechanical restrictions, operating efficiency and so on.

What is claimed is:

1. A card switching apparatus for a dobby comprising:

a first gear securely mounted on a rotary shaft of a cylinder with a card, which is supported on a bracket mounted for rocking motion around a first shaft;

a driving gear securely mounted on an input shaft driven in response to a loom;

an idle gear supported on a second shaft, said idle gear being disposed between the first gear and the driving gear and transmits the rotation of the input shaft to the cylinder;

an eccentric crank lever being connected to and supporting a second shaft of the idle gear thereon; and a motor for moving the crank lever, a second gear supported on the bracket and engaged with the first gear, wherein said idle gear comprises a third gear which is supported on the second shaft extending through a cam slot formed in a cam plate and is in meshed engagement with the second gear and the driving gear, said cam plate being secured to a frame, wherein said eccentric crank lever has a round hole formed at the end portion opposite the second shaft, and an eccentric disk is fitted in the round hole of the crank lever and is secured to a shaft of the motor, whereby said crank lever is displaced to move the second shaft along the cam slot in response to a rotational angle of the shaft of the motor;

wherein said cam slot consists of a levelling cam slot formed to extend from a position corresponding to the forward rotation position of the second shaft for normal operation to a first arc centering around the center of the driving gear and another reverse rotating cam slot formed contiguously to the levelling cam slot and extending from the position to a second arc centering around the center of the second gear.

2. A card switching apparatus as claimed in claim 1, wherein a rotary plate having a dog for detecting a rotational angle of the shaft of the motor is secured to the shaft of the motor and a plurality of contactless sensors for detecting the dog are located at positions to detect the forward rotation position of the third gear, the reverse rotation position of the third gear and the levelling position of the third gear, respectively.

3. A card switching apparatus as claimed in claim 2, wherein button switches for activating the motor for reverse, rotating, and levelling operation are mounted on a cover which covers the card switching apparatus.

* * * * *